US006389965B1

(12) United States Patent
Vrotacoe et al.

(10) Patent No.: US 6,389,965 B1
(45) Date of Patent: May 21, 2002

(54) TUBULAR PRINTING BLANKET WITH TUBULAR ISOTROPIC REINFORCING LAYER

(75) Inventors: James Brian Vrotacoe, Rochester; Richard Karl Weiler, Durham, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/469,114

(22) Filed: Dec. 21, 1999

(51) Int. Cl.[7] ..... B41N 10/04
(52) U.S. Cl. ..... 101/217; 101/376; 428/909
(58) Field of Search ..... 101/216, 217, 101/375, 376; 428/909

(56) References Cited

U.S. PATENT DOCUMENTS

| | | | | |
|---|---|---|---|---|
| 3,881,045 A | * | 4/1975 | Strunk | 428/909 |
| 3,981,237 A | * | 9/1976 | Rhodes | 101/128.4 |
| 4,042,743 A | | 8/1977 | Larson et al. | 428/306 |
| 4,378,622 A | * | 4/1983 | Pinkston et al. | 101/376 |
| 4,913,048 A | * | 4/1990 | Tittgemeyer | 101/375 |
| 4,981,750 A | | 1/1991 | Murphy et al. | 428/220 |
| 5,301,610 A | * | 4/1994 | McConnell | 101/375 |
| 5,304,267 A | | 4/1994 | Vrotacoe et al. | 156/86 |
| 5,323,702 A | | 6/1994 | Vrotacoe et al. | 101/217 |
| 5,347,927 A | | 9/1994 | Berna et al. | 101/401.1 |
| 5,352,507 A | | 10/1994 | Bresson et al. | 428/245 |
| 5,429,048 A | | 7/1995 | Gaffney et al. | 101/217 |
| 5,700,343 A | | 12/1997 | Castelli et al. | 156/295 |
| 5,768,990 A | | 6/1998 | Vrotacoe et al. | 101/217 |
| 5,860,360 A | * | 1/1999 | Lane, III et al. | 101/376 |
| 5,861,216 A | * | 1/1999 | Doane et al. | 428/532 |
| 6,019,042 A | * | 2/2000 | Batti et al. | 101/376 |

FOREIGN PATENT DOCUMENTS

| | | |
|---|---|---|
| DE | 2415932 | 10/1975 |
| EP | 0366395 | 5/1990 |
| EP | 0715966 | 6/1996 |
| EP | 0727326 | 8/1996 |
| WO | 9726141 | 7/1997 |

* cited by examiner

*Primary Examiner*—Leslie Evanisko
(74) *Attorney, Agent, or Firm*—Davidson, Davidson & Kappel, LLC

(57) ABSTRACT

A tubular printing blanket including a tubular print layer, a tubular isotropic plastic reinforcing layer underneath the print layer, a compressible layer underneath the reinforcing layer, and a sleeve for supporting, directly or indirectly, the compressible layer es axial stability due to its isotropic nature and the plastic material. Also disclosed is a method for manufacturing a tubular printing blanket including forming a tubular reinforcing layer and sliding the tubular reinforcing layer over a compressible layer. Furthermore, a device for manufacturing a tubular printing blanket is also provided. A first build cylinder has an outer diameter. A mandrel cap can be attached to one end of the build cylinder, the mandrel cap having an outer diameter larger than the build cylinder outer diameter.

14 Claims, 4 Drawing Sheets

TUBULAR PRINTING BLANKET WITH TUBULAR ISOTROPIC REINFORCING LAYER

BACKGROUND OF THE INVENTION

1. Field of the Invention

The present invention relates generally to offset printing presses and more particularly to a tubular printing blanket for an offset lithographic press.

2. Background Information

U.S. Pat. No. 5,429,048 to Gaffney et al purports to disclose an offset lithographic printing press in which a web of material to be printed passes through a series of print units. Each of the print units has an upper plate cylinder, an upper blanket cylinder, a lower blanket cylinder and a lower plate cylinder. Printing plates containing images may be fastened to the plate cylinders and gapless tubular-shaped blankets may be fastened to the blanket cylinders. During a printing operation, the web passes between the upper blanket and the lower blanket. The tubular-shaped blanket of the printing press includes an outer print layer of incompressible material, a second layer of compressible material under the print layer and a third layer of incompressible material attached to a nickel sleeve. The patent mentions at column 12, line 19 et seq. that a deflectable fabric or inextendable layer could be provided between or inside each of the layers.

U.S. Pat. Nos. 5,304,267 and 5,323,702 purport to disclose tubular printing blankets having an outer print layer of elastomeric material, an inextensible layer under the print layer, and a compressible layer under the inextensible layer which is connected to a nickel sleeve. The inextensible layer is made of a seamless tubular body of elastomeric material and a longitudinally inextensible thread within the tubular body 100. The patent also discloses that the inextensible layer could be formed of a seamless tubular body of material such as a urethane copolymer, thermosetting polymers and rubbers. This material has a modulus of elasticity in the range of 2500–10,000 psi. Alternatively, the patent discloses an embodiment in which a continuous piece of plastic film extends in a spiral through an elastomeric material of an inextensible layer. The plastic film is not joined or merged together and does not form an isotropic layer.

U.S. Pat. No. 5,352,507 purports to disclose a sleeve-like printing blanket. Underneath a printing layer is an elastomeric layer having reinforcing fibers therein. The elastomeric layer may be an elastomeric-impregnated nonwoven mat, of, for example, spunlaced aramid fibers or spunbonded nonwoven polyester. Holes in the nonwoven are filled with elastomeric material in a complex impregranation step. The reinforced elastomeric layer then is placed on the blanket either by spiral wrapping or by wrapping a sheet of material to abut, and then curing so that the elastomeric material tends to merge or meld. As best understood, only the elastomeric material melds together while the material of the mat does not meld or merge.

The reinforcing layers of the blankets discussed above have been concerned primarily with providing stability in the radial direction. However, the tubular printing blankets disclosed above suffer from the problem that the reinforcing layers underneath the printing layers lack stiffness and strength in the cross-web or axial direction. The lack of stiffness and strength in the cross-web direction can lead to a relatively short lifespan, as circumferential cracks can form which can eventually lead to delamination. The reinforcing layers discussed above also are formed directly over the compressible layer, which can lead to difficult curing requirements which can be expensive and may damage, for example, the compressible layer.

U.S. Pat. Nos. 4,981,750 and 4,042,743 purport to disclose flat blankets which have a reinforcing layer underneath the printing layer. These blankets however must be clamped in a clamping mechanism and cannot be used as tubular blankets.

BRIEF SUMMARY OF THE INVENTION

An object of the present invention is to improve the durability of tubular blankets. Another additional or alternative object is to provide for a simple method of manufacturing tubular blankets.

The present invention provides a tubular printing blanket including a tubular print layer, a tubular isotropic thermoplastic reinforcing layer underneath the print layer, a compressible layer underneath the reinforcing layer, and a sleeve for supporting, directly or indirectly, the compressible layer.

The tubular isotropic thermoplastic reinforcing layer provides axial stability due to its isotropic nature and the thermoplastic material. "Thermoplastic" as defined herein includes thermosetting materials.

Preferably, the tubular printing blanket includes a build-up layer between the sleeve and the compressible layer. The build-up layer preferably is made of a hard rubber material.

Preferably, the reinforcing layer is made of polyester, most preferably MYLAR or MELENEX from the DuPont Corporation, and is preformed in a tubular shape so as to be isotropic. The MYLAR may be approximately 0.008 inches thick, with an inner diameter when relaxed of 7.0504 inches, for example. Preferably, the reinforcing layer is made of a homogeneous thermoplastic film. Thus isotropic tubular reinforcing layer preferably is made solely of thermoplastic sheet material.

The present invention also provides a tubular print layer, a tubular isotropic reinforcing layer underneath the print layer and having a modulus of elasticity in the range of 100,000 to 1,000,000 psi, a compressible layer underneath the reinforcing layer, and a sleeve for supporting, directly or indirectly, the compressible layer. This high modulus of elasticity aids in providing axial stability. Preferably, the modulus of elasticity is 500,000 to 1,000,000 psi.

The present invention also provides a method for manufacturing a tubular printing blanket including forming a tubular reinforcing layer and sliding the tubular reinforcing layer axially over a compressible layer. The compressible layer is supported by a sleeve. A printing layer then is added over the reinforcing layer.

Preferably the tubular reinforcing layer is made of thermoplastic, most preferably a polyester film such as MYLAR. Preferably, the tubular reinforcing layer is isotropic.

Advantageously, the method may include providing compressed air to an inner surface of the reinforcing layer during the sliding step. Once the reinforcing layer is slid over the compressible layer the compressed air is no longer provided. The reinforcing layer relaxes to form a fit with the compressible layer. Preferably, the tubular reinforcing layer is first slid over a mandrel cap which has a diameter larger than the sleeve.

A device for manufacturing a tubular printing blanket is also provided. A first build cylinder has an outer diameter. A mandrel cap can be attached to one end of the build cylinder, the mandrel cap having an outer diameter larger than the build cylinder outer diameter. The mandrel cap may include air holes at its outer diameter for providing pressurized air to the inside of an isotopic reinforcing layer.

The blankets of the present invention can attain a longer lifespan because of improved axial strength due to the isotropic reinforcing layer. The manufacture of the blanket using the tubular reinforcing layer also removes the need for a curing step on the build cylinder in forming the reinforcing layer. The pre-forming of the reinforcing layer in mass-production ahead of time can reduce manufacturing costs.

BRIEF DESCRIPTION OF THE DRAWINGS

The present invention is described below by reference to the following drawings, in which.

DETAILED DESCRIPTION

Figure 1:
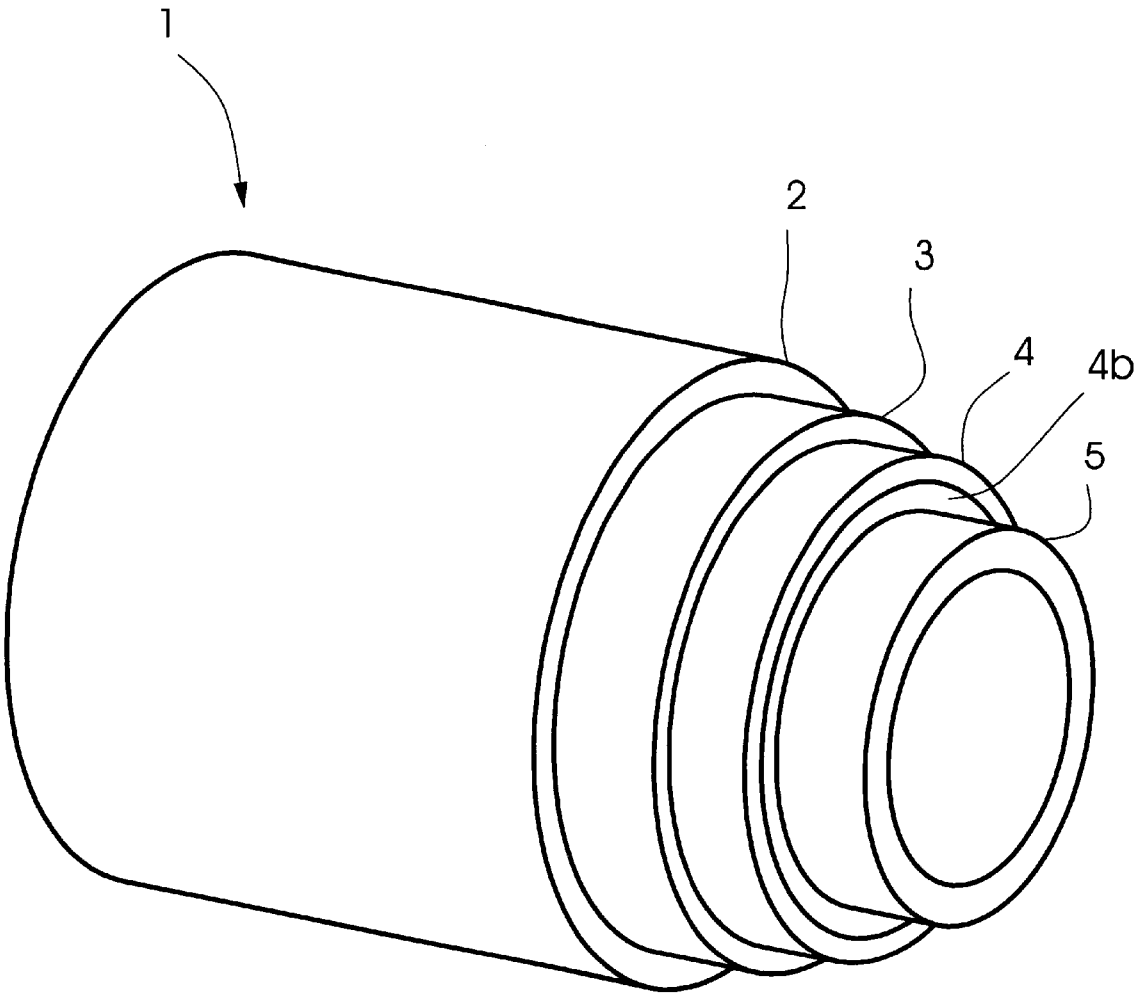
FIG. 1 shows a perspective view of the blanket of the present invention.

FIG. 1 shows in perspective view a preferred embodiment of a tubular printing blanket 1 of the present invention. Tubular blanket 1 includes an outer print layer 2, a tubular isotropic thermoplastic reinforcing layer 3, a compressible layer 4 and an inner sleeve 5.

Outer print layer 2, compressible layer 4, and inner sleeve 5 may be, for example, similar to print layers, compressible layers and inner sleeves, disclosed in U.S. Pat. Nos. 5,304,267, 5,323,702 and 5,429,048, which are hereby incorporated by reference herein. Preferably the print layer is made of rubber, the compressible layer of rubber having voids, and the sleeve of nickel.

The tubular reinforcing layer 3 preferably is made from a smooth, homogenous polyester film and a polyester resin adhesive so that the layer is isotropic. Preferably, the polyester film is MYLAR, a biaxially-oriented thermoplastic film available from the DuPont Corporation. The layer may be made for example of 0.008 inch thick MYLAR film.

Figure 2:
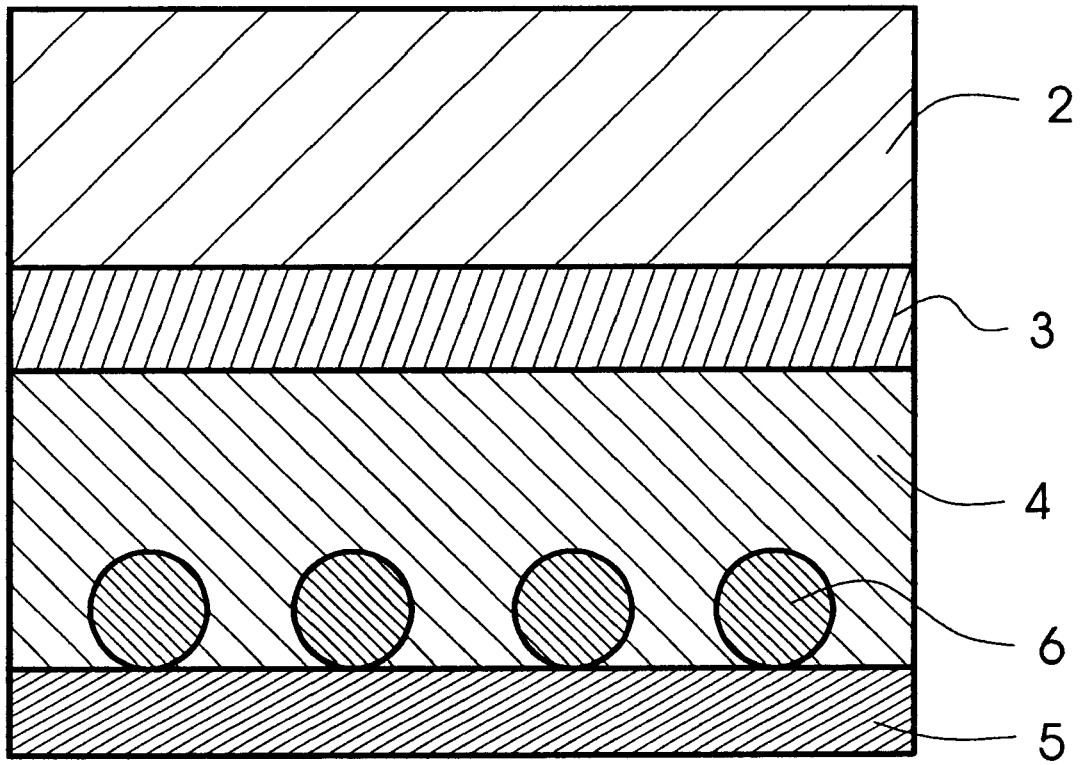
FIG. 2 shows a schematic simplified cross-sectional view of the blanket of the present invention.

FIG. 2 shows a partial cross-section of the blanket 1. Print layer 2, reinforcing layer 3, compressible layer 4 and sleeve 5 are shown. A compressible cord 6 providing the compressibility in the compressible layer 4 is shown schematically. Air bubbles may also be used to provide compressibility in layer 4. As shown in FIG. 1, build-up layer 4*b* of hard rubber preferably is provided between the compressible layer 4 and the sleeve 5.

Figure 3:
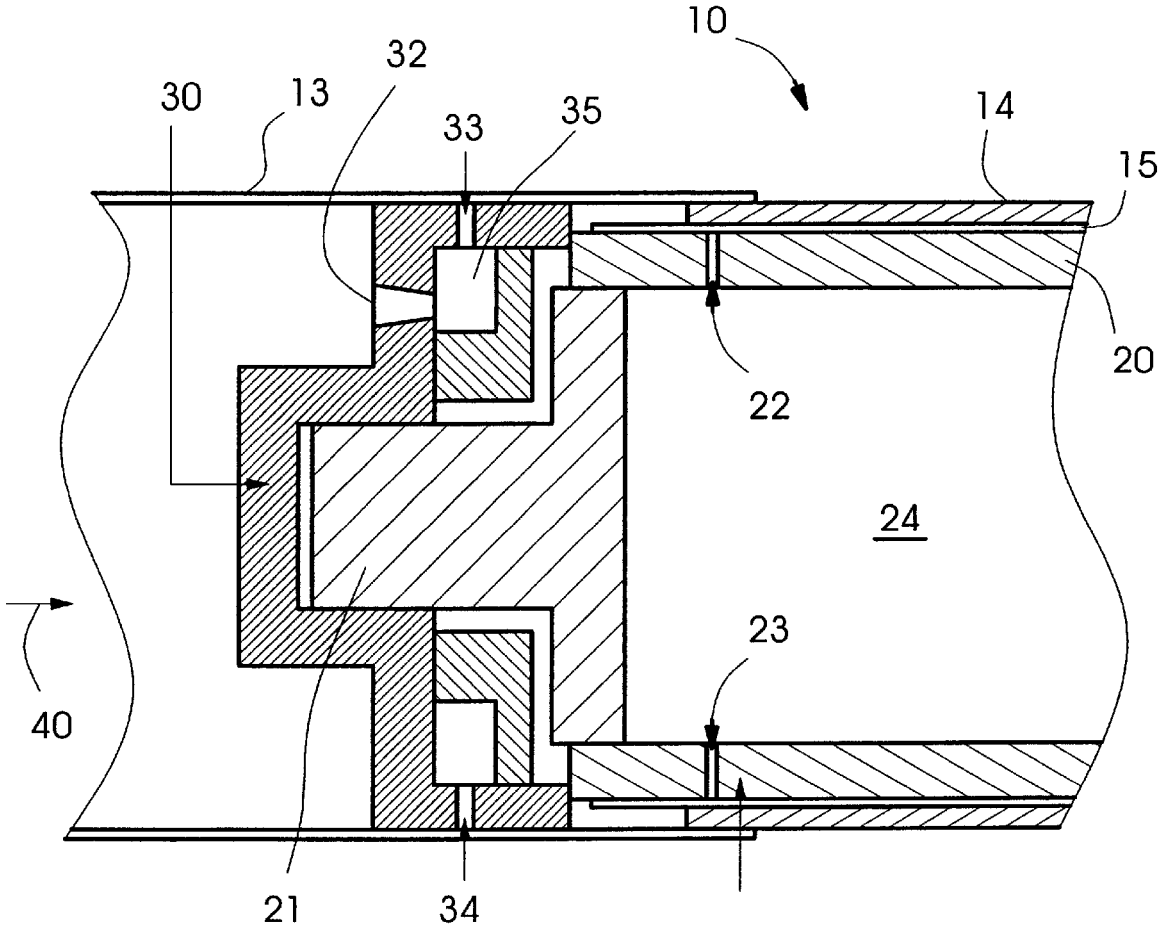
FIG. 3 shows a side view of the manufacture of the blanket according to the present invention.

FIG. 3 shows a partially constructed tubular blanket 10 on a build cylinder 20. Blanket 10 already has a sleeve 15 and compressible layer 14. An isotropic tubular reinforcing layer 13 is slid over a mandrel cap 30 attached to an end 21 of build cylinder 20, for example by a screw type arrangement. Air holes 22 and 23 are provided in cylinder 20 and extend to an outer surface of cylinder 20 from an inner chamber 24 of build cylinder 20. More than two such holes may be provided. Inner chamber 24 is connected to a source of pressurized air, so that pressurized air may provided to the inner surface of sleeve 15 to help remove blanket 10 after blanket 10 is fully constructed.

Mandrel cap 30 has an air inlet 32, a circumferentially extending air slot 35 and air exit holes 33 and 34. Air inlet 32 can connect to a pressurized air source, through, for example, a tube. The outer diameter of mandrel cap 30 is about the same size as the outer diameter of compressible layer 14 and the inner diameter of tubular reinforcing layer 13. To assemble blanket 10, reinforcing layer 13 is slid axially in the direction of arrow 40 over the mandrel cap 30, aided by air pressure from air exit holes 33 and 34, although additional air exit holes may be provided. Reinforcing layer 13, once located over the compressible layer 14, relaxes to form a friction fit with compressible layer 14. The friction fit of the reinforcing layer 13 may also be assisted by using a bonding cement on either or both sides.

A print layer may then be applied to the reinforcing layer 13, for example, by curing rubber.

Figure 4:
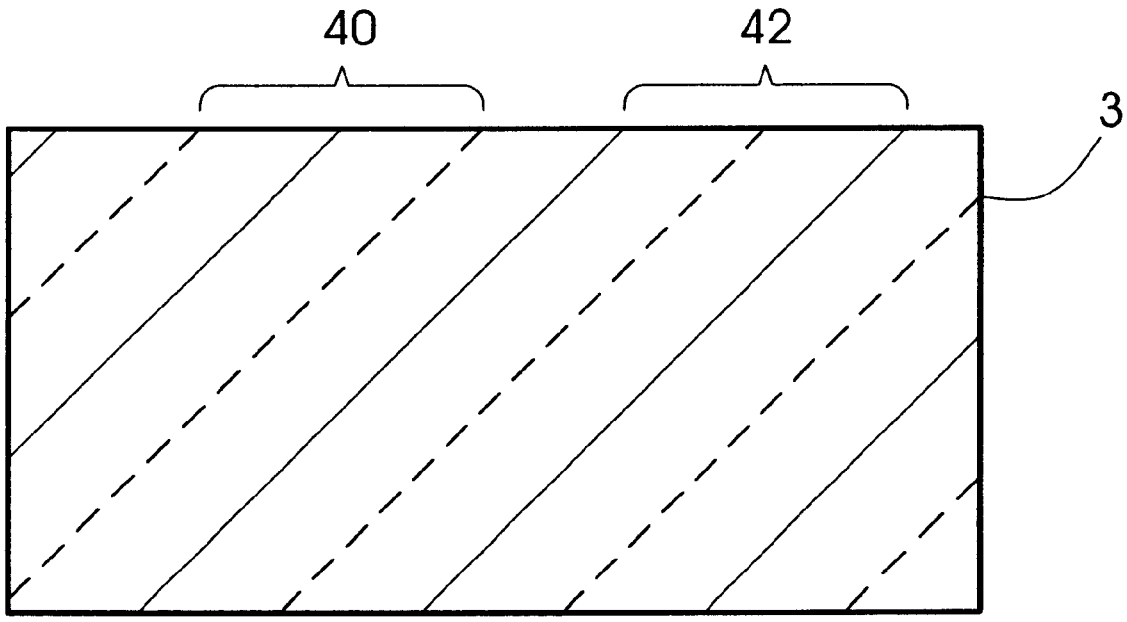
FIG. 4 shows schematically the construction of the isotropic plastic tubular layer.

FIG. 4 shows a possible construction of isotropic tubular reinforcing layer 3. Tubular reinforcing layer may be made by wrapping a first strip 40 of polyester film (indicated by dashed lines) spirally so that the edges abut tightly. A second strip 42 of polyester film is wrapped spirally over the first strip 40 so that the edges of first strip 40 are covered. A polyester resin adhesive is placed between the two strips 40 and 42 and between the abutting edges, so that a uniform isotropic polyester tube is formed. The edges may then be trimmed square to form the tubular layer 3. The tubular layer 3 provides excellent radial and axial stability owing to its isotropic nature and the thermoplastic material from which it is constructed. The modulus of elasticity for the tubular material preferably is in the range of 100,000–1,000,000 psi, and most preferably between 500,000 and 1,000,000 psi.

The thermoplastic tubular layer however also may be extruded from a thermoplastic material so as to form a tube.

What is claimed is:

1. A tubular printing blanket comprising:

a tubular print layer;

a tubular isotropic thermoplastic reinforcing layer underneath the print layer;

a compressible layer underneath the reinforcing layer; and a sleeve for supporting the compressible layer.

2. The tubular printing blanket as recited in claim 1 wherein the reinforcing layer is made of a polyester material.

3. The tubular printing blanket as recited in claim 2 wherein the reinforcing layer is made of a biaxially-oriented thermoplastic film.

4. The tubular printing blanket as recited in claim 1 wherein the reinforcing layer is made from a homogeneous film and an adhesive of the same material as the homogeneous film.

5. The tubular printing blanket as recited in claim 1 wherein the reinforcing layer includes two spirally wound strips of polyester film.

6. The tubular printing blanket as recited in claim 1 wherein the reinforcing layer is an extruded tube.

7. A tubular printing blanket comprising:

a tubular print layer;

a tubular isotropic reinforcing layer underneath the print layer having a modulus of elasticity between 100,000 and 1,000,000 psi;

a compressible layer underneath the reinforcing layer; and a sleeve for supporting the compressible layer.

8. The tubular printing blanket as recited in claim 5 wherein the reinforcing layer is made from a homogeneous film and an adhesive of the same material as the homogeneous film.

9. The tubular printing blanket as recited in claim 5 wherein the modulus of elasticity is between 500,000 and 1,000,000 psi.

10. The tubular printing blanket as recited in claim 5 further comprising a build-up layer between the compressible layer and the sleeve.

11. The tubular printing blanket as recited in claim 7 wherein the reinforcing layer is made of a thermoplastic.

12. The tubular printing blanket as recited in claim 7 wherein the reinforcing layer is made of a polyester material.

13. The tubular printing blanket as recited in claim 7 wherein the reinforcing layer includes two spirally wound strips of polyester film.

14. The tubular printing blanket as recited in claim 7 wherein the reinforcing layer is an extruded tube.

* * * * *